United States Patent [19]

Ayers et al.

[11] Patent Number: 4,549,378

[45] Date of Patent: Oct. 29, 1985

[54] MOBILE HOME SKIRTING SYSTEM

[75] Inventors: Ralph L. Ayers, Kearney; Garfield W. Stovin; Robert J. Szabo, both of Kansas City, all of Mo.

[73] Assignee: Variform Plastics, Inc., Kearney, Mo.

[21] Appl. No.: 503,715

[22] Filed: Jun. 13, 1983

[51] Int. Cl.[4] ..... E04D 1/00

[52] U.S. Cl. ..... 52/169.12; 52/520; 52/DIG. 3

[58] Field of Search ..... 52/169.12, DIG. 3, 529, 52/520; 280/768

[56] References Cited

U.S. PATENT DOCUMENTS

| | | | |
|---|---|---|---|
| 3,205,632 | 9/1965 | McCormick | 52/529 X |
| 3,438,168 | 4/1969 | Tischuk | 52/520 X |
| 4,214,412 | 7/1980 | Barylski | 52/169.12 |

*Primary Examiner*—Carl D. Friedman

*Attorney, Agent, or Firm*—Schmidt, Johnson, Hovey & Williams

[57] ABSTRACT

An improved skirting assembly for mobile homes or other elevated buildings is provided which has specialized connectors between the skirt and building permitting up and down travel of the skirt, and an upper covering channel completely free of connection to the building so as to accommodate any degree of skirt movement. In preferred forms, the skirt includes a plurality of endwise interlocked panels operably connected to the building by means of connection structure such as a bracket matingly and slidingly receiving one of the interlocking flanges of a panel; the corresponding flange on the adjacent panel overlies and slidingly receives the bracket so as to conceal the latter while achieving the desirable sliding connection. In other forms, a slotted clip (or a slot provided in the skirt panels themselves) is employed to obtain the sliding connection without the need to affix the upper covering channel to the building.

7 Claims, 9 Drawing Figures

Fig. 1.
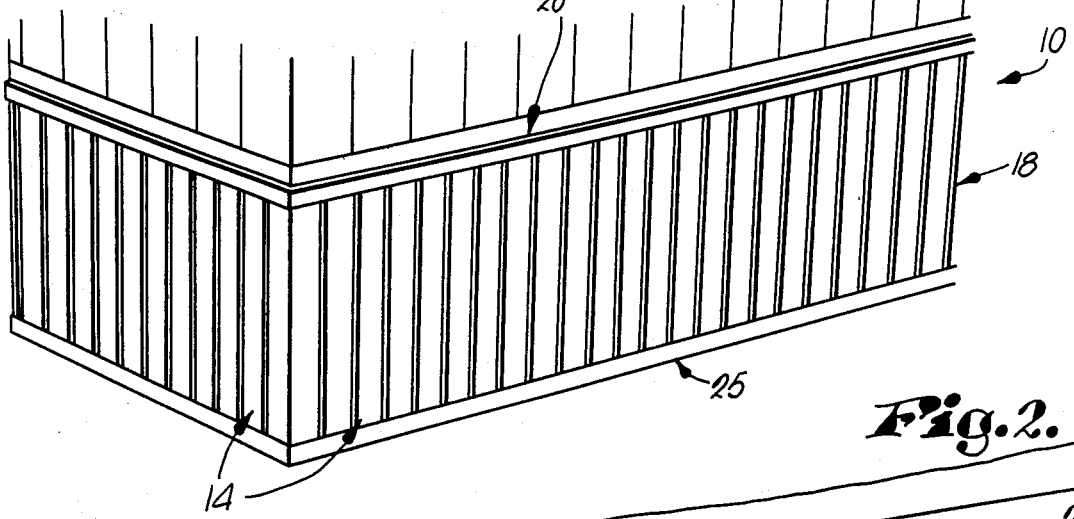
Fig. 2.
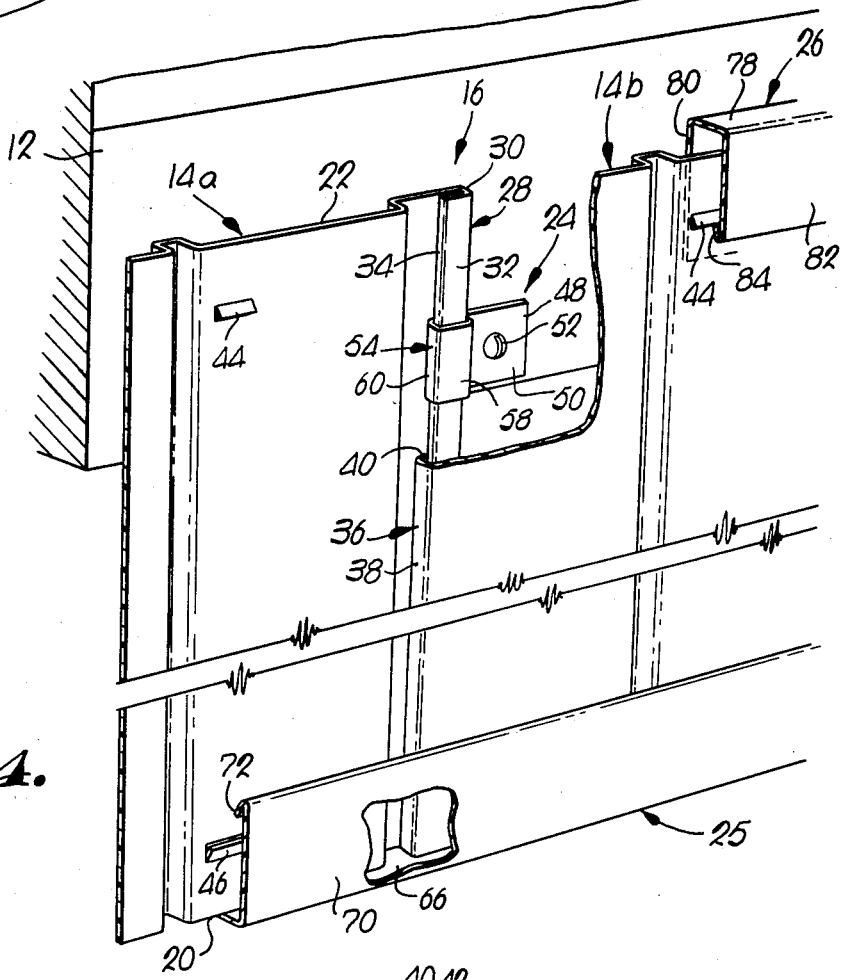
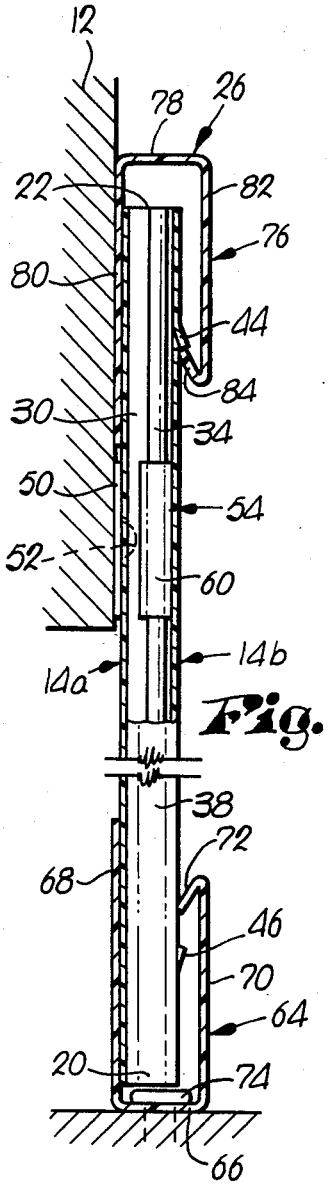
Fig. 4.
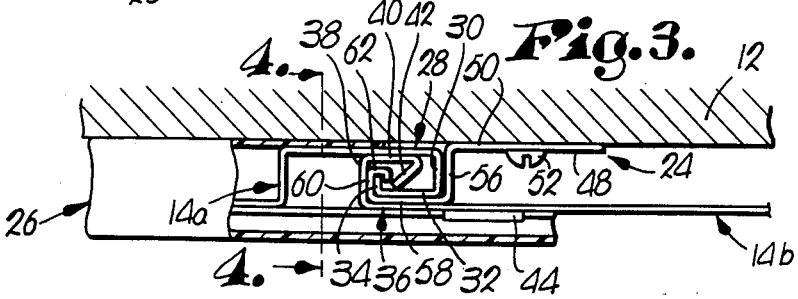
Fig. 3.

MOBILE HOME SKIRTING SYSTEM

BACKGROUND OF THE INVENTION

1. Field of the Invention

The present invention is broadly concerned with a greatly improved skirting assembly designed to be installed beneath elevated buildings such as mobile homes and the like in order to cover the normal space beneath such buildings and to present an aesthetically pleasing, structurally sound, blowout-resistant covering skirt. More particularly, it is concerned with such a skirting assembly which can be efficiently manufactured by provision of specialized connection structure for coupling the skirt to the building while permitting relatively unrestricted up and down reciprocal travel thereof, along with an upper channel-like cover disposed over the upper marginal edge of the skirt and free of any connection to the building itself. In this manner, the skirting assembly can accommodate any degree of skirt movement resulting from frost heave or movement of the underlying earth, while avoiding the necessity of providing an upper covering skirt affixed to the building which in turn necessitates that a relatively large cover be provided so as to accommodate all normal degrees of skirt panel shifting.

2. Description of the Prior Art

Elevated buildings, such as mobile homes, are somewhat universally provided with circumscribing skirts for closing the space beneath the building, the advantages emanating from the use of such skirting being well known. In the interests of simplicity, savings and expense and ease of installation, it is commonplace to construct the skirting by use of a continuous series of relatively light weight, yet strong synthetic resin panels releasably interconnected at their adjacent upright edges by various types of interlocks. Moreover, it is very common to provide decorative upper and lower marginal covers for the skirting system. Normally, the lower cover is in the form of a channel member which receives the lowermost marginal edge of the skirt, and is staked to the ground.

On the other hand, the upper elongated skirt covers have without known exception been affixed directly to the building by appropriate connectors. In order to accommodate normal up and down reciprocal travel of the skirt by virtue of frost heaving or settling, such upper covers are typically provided with a relatively long vertical space therewithin for accommodating skirt panel travel. In this regard, in order to assure that all normal shifting of the skirting panels can be accommodated without damage to the upper covers, it has been the practice to construct the channels with the ample shifting space described above; in short, the practice has been to design these covers on a "worst case" basis in order to safely accommodate all degrees of skirt panel shifting. While this practice is common, it inherently wastes material and increases the cost of the overall skirting assembly. That is to say, in climates where frost heaving is of minimal significance, it necessarily follows that less space is required in the upper channel member to accommodate shifting; yet, in order to assure uniformity, manufacturers have generally used only one size of upper cover member for their skirting assemblies, notwithstanding the fact that in many instances this constitutes a relatively costly expedient.

Prior skirting systems for mobile homes and the like are described in U.S. Pat. Nos. 3,710,525, 2,988,380, 4,107,888, 3,113,357, 4,214,412, 3,382,813, 4,043,088, and in Canadian patent No. 1,022,719. In addition, prior skirting assembly is described in copending application Ser. No. 06/255,302, filed April 17, 1981, now Patent No. 4,400,919.

SUMMARY OF THE INVENTION

The problems outlined above are in large measure solved by the present invention which provides a greatly improved, cost effective skirting assembly for mobile homes or like elevated buildings. Broadly speaking, the assembly hereof includes a plurality of upright panels disposed in a generally end to end relationship, with means for interconnecting the panels to present a substantially continuous closing skirt having a pair of opposed faces and an elongated upper margin. Connector means is provided for securing the skirt beneath a building such as a mobile home, and for permitting up and down reciprocal travel of the skirt. This connector means includes structure for fixed securement to the building, and means operably coupled with the fixedly secured structure for engaging the skirt in a manner to permit such up and down travel thereof. The skirting assembly also includes cover means for covering the upper margin of the skirt and includes an elongated channel member of inverted, generally U-shaped configuration having depending, spaced apart legs. The panel member is positioned over the upper margin of the skirt with the legs respectively disposed proximal to one of the opposed faces of the skirt. Finally, the channel member is free of fixed securement to the building in order to move in an up and down reciprocal fashion with the skirt, and to any degree that the latter so moves.

In particularly preferred forms, the skirt panels are interconnected by means of mating interlock flanges on adjacent upright edges of the panel, and in this event the connector means comprises a specialized bracket. The bracket is fixedly secured to the building by means of a screw or other appropriate connector, and has a skirt-engaging end configured to matingly and slidingly receive one of the interlocked flanges. The other of the interlocked flanges on the adjacent panel is configured to fit over and slidingly receive the skirt-engaging end of the bracket. In this fashion, the bracket itself is completely concealed from view, while nevertheless providing the desirable up and down sliding connection between the building and the skirt.

In other forms of the invention, the panel members themselves are provided with elongated, upright slots therein, and for purposes of providing a sliding connection, a screw is inserted through each slot and is affixed to the building; in this fashion, vertical movement of the skirt is acommodated by a sliding movement of the respective panels relative to the screw connector. In this form of the invention, it is advantageous to provide elongated covers likewise affixed to the associated screw means and covering the panel slots.

Finally, in yet another embodiment of the invention, a clip member is provided which includes an elongated, vertically slotted portion secured to the building by means of a screw or the like, along with an upper portion of generally inverted, U-shaped configuration which passes over the upper margin of the skirt and is housed within the upper channel member. Here again, the slotted configuration of the clip permits the desirable up and down movement of the skirting assembly without the need for connection of the upper cover member directly to the building itself.

BRIEF DESCRIPTION OF THE DRAWINGS

FIG. 1 is a perspective view of the end of a mobile home having the skirting assembly of the present invention installed thereon;

FIG. 2 is a fragmentary view with parts broken away for clarity of the preferred skirting assembly of the invention;

FIG. 3 is a top view with parts broken away for clarity illustrating the interconnection between respective adjacent panels of the skirt, as well as the configuration of the preferred skirt connection bracket;

FIG. 4 is a fragmentary vertical sectional view taken along line 4—4 of FIG. 3 with the top portion broken away to show additional detail as depicted in FIG. 2:

DESCRIPTION OF THE PREFERRED EMBODIMENTS

Figure 5:
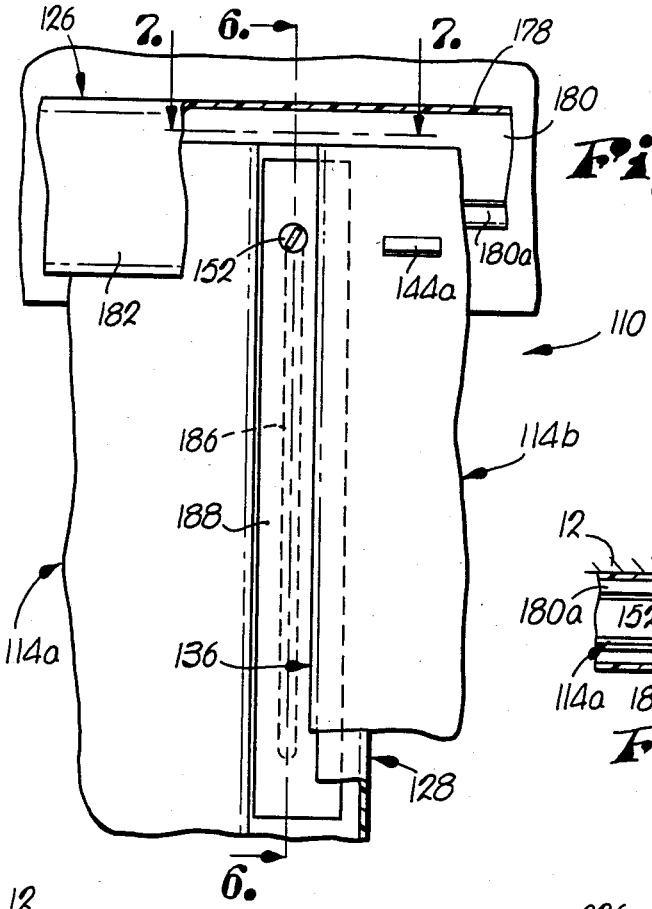
FIG. 5 is a fragmentary front view with parts broken away for clarity and with certain structure depicted in phantom of another embodiment of the invention.

Turning now to the drawings, a skirting assembly 10 is illustrated in its fully constructed, attached form in FIG. 1, in closing relationship to the normal space between a conventional mobile home 12. Broadly speaking, the assembly 10 includes a plurality of upright, corrugated, synthetic resin panels 14 disposed in a generally end to end relationship and provided with interconnection structure 16 (see FIG. 2) serving to interlock the respective panels to present a substantially continuous closing skirt 18 presenting opposed inner and outer faces, an elongated lower margin 20 and an opposed, parallel, elongated upper margin 22. The overall assembly 10 further includes connector means broadly referred to by the numeral 24 for securing the skirt 18 beneath the building 12, and for permitting up and down reciprocal travel of the skirt under the influence of ground forces or the like. Finally, the assembly includes an elongated, lowermost ground-engaging cover 25 which operably engages and covers the margin 20 of the skirt 18, and upper cover means 26 for covering the upper margin 22 of the skirt 18.

In more detail, each panel 14 is of substantially rectangular configuration and includes a plurality of upright corrugations for added strength. The panels are formed of conventional synthetic resin material such as a vinyl, and are normally colored and provided with a surface texture for aesthetic reasons. Referring specifically to FIG. 2, it will be seen that a pair of adjacent panels **14*a* and 14*b* are depicted. In this regard, it will be noted that the righthand vertical edge of panel 14*a* is configured to present an upright interlocking flange 28 which presents an outwardly extending first leg 30, a second leg 32 substantially parallel with the main body of the panel, and finally a short, inwardly directed terminus 34 (see FIG. 3). On the other hand, the opposite vertical edge of panel 14*a*, and the adjacent vertical edge of panel 14*b*, are configured to present an upright locking flange 36. The interlocking flange 36 includes a rearwardly extending first leg 38, second leg 40 generally parallel with panel 14*b*, and an obliquely oriented terminus leg 42. The locking flanges 28, 36** interfit in a manner to be described in detail hereinafter and as illustrated in FIG. 3.

As best seen in FIGS. 2, 4, each panel 14 further includes a series of obliquely and downwardly extending tabs 44 adjacent upper margin 22, and similarly a series of obliquely and upwardly extending tabs 46 proximal to lower margin 20. The purpose of these tabs 44, 46 will likewise be explained in detail hereinafter.

Connector means 24 is advantageously in the form of a bracket 48 for each joinder of the panels 14. As best seen in FIGS. 2 and 3, the bracket 48 includes a planar connection stretch 50 which is apertured for passage of a connection screw 52 therethrough, as well as a connection end 54. The end 54 is configured to present a first outwardly extending leg 56, a second leg 58 generally parallel with stretch 48, a third inwardly extending leg 60, and finally a hook shaped terminus 62. As best seen in FIG. 3, the end 54 of bracket 48 is designed to matingly and slidingly receive the interlocking flange 28 of panel **14*a*; by the same token, the interlocking flange 36 of panel 14*b* is designed to matingly receive and conceal the bracket connection end 54**, and to be slidable relative thereto.

Lower cover 25 is in the form of a plurality of end to end positioned channel members 64 each presenting a planar, apertured bight 66 as well as a pair of spaced, upstanding legs 68, 70. The forward leg 70 includes an obliquely oriented return flange 72 which is engageable with tab 46 during operation of the assembly 10 as will be described. As illustrated in FIG. 4, the channel members 64 are attached to the earth by means of stakes 74.

Upper cover means 26 is advantageously in the form of a plurality of end to end positioned, inverted, generally U-shaped channel members 76 each presenting a generally planar uppermost bight 78 as well as a pair of depending, spaced, opposed legs 80, 82. Forwardmost leg 82 is provided with an upstanding, oblique return flange 84 configured and located for engagement with tab 44 as illustrated in FIG. 4.

The skirting assembly 10 is constructed by first attaching a bracket 48 to building 12 at a convenient location, followed by insertion of an interlocking flange 28 of panel **14*a* into the confines of connection end 54. The next step involves sliding the interlocking flange 36 of an adjacent panel 14*b* over the connection end 54 and the first installed flange 28, so as to provide an interconnected pair of panels extending in opposite directions from the bracket 48. This process is then repeated by successively installing additional brackets and panels around the entire periphery of the building 12 until a complete, circumscribing and interconnected skirt 18** is presented.

The upper and lower covers 25, 26 are also locked in place during this procedure by slipping the open ends of the respective channel members 64, 76 over the lower and upper margins 20, 22 of the interconnected skirt-defining panels. In both instances the respective return flanges 72, 84, are slid past the associated tabs 46, 44, so as to loosely lock the channel member in place by virtue of an interference fit between the tabs 44, 46, and the corresponding return flanges 84, 72. In the case of the lower channel members 64, the stakes 74 are employed to fixedly secure the same to the earth (see FIG. 4).

In operation, when the earth shifts or heaves due to normal environmental conditions, upwardly directed forces are first directed against the lower cover means 25, with the result that the respective interconnected panels 14 are likewise pushed upwardly. Such upward travel of the skirt-defining panels is accommodated and guided by virtue of the sliding connection between such panels and the brackets 48. Moreover, inasmuch as upper cover means 26 is completely free of any connection to the building 12, it will be seen that the upper cover will ride with the panels 14 as they shift, notwithstanding the actual distance of travel thereof. Similarly, when the supporting earth shifts downwardly the panels 14 and the interconnected upper and lower cover means 25, 26 likewise shift downwardly. Here again, the sliding connection afforded by virtue of the brackets 48 and lack of connection between cover means 26 and building 12, greatly facilitates the downward sliding travel.

Figure 6:
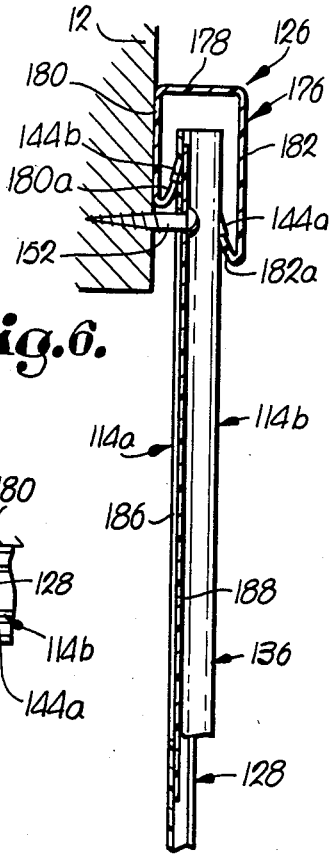
FIG. 6 is a vertical sectional view taken along line 6—6 of FIG. 5 and further illustrating the structure of this skirt assembly embodiment.
Figure 7:
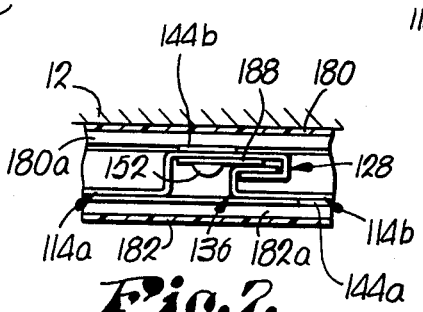
FIG. 7 is a sectional view taken along line 7—7 of FIG. 5 which depicts the interconnection between adjacent skirt panels, as well as the connection structure coupling the skirt to the elevated building.

Attention is next directed to FIGS. 5–7 which illustrate another embodiment of the invention. In this instance a skirting system 110 is depicted which is in many respects identical with assembly 10 and includes interconnected panels 114, such as the panels **114*a* and 114*b* of FIG. 5**.

As best seen in FIGS. 5, 7, the panel **114*a* includes an interlocking flange 128 adjacent its righthand vertical edge along with a vertically extending slot 186 adjacent the end 128. The end 128 is generally U-shaped in cross section, as will be observed from a study of FIG. 7. The vertical edge of panel 114*a* remote from flange 128, as well as the adjacent, interlocking flange edge of panel 114*b*, is configured to present a somewhat U-shaped in cross section interlocking flange 136. As illustrated in FIG. 7, the flanges 128, 136** interfit and are vertically shiftable relative to each other.

A connection screw 152 extends through the slot 186 and into building 12 to provide a connection to the latter. In order to cover the otherwise open slot 186, an elongated, generally rectangular synthetic resin cover plate 188 is provided which is secured in place by screw 152 as will be readily observed from a study of FIG. 5. The lower cover means for the system 110 is identical with that described in connection with assembly 10, and need not be further discussed. The upper cover means 126 is substantially similar, and is in the form of a plurality of end to end positioned channel members 176 each presenting an uppermost bight 178 and a pair of depending, spaced apart legs 180, 182. Each of the legs 180, 182, is provided with an upturned, obliquely oriented return flange **180*a*, 182*a*. Cooperating, outwardly projecting, obliquely oriented locking tabs 144*a* and 144*b* are provided on the panels 114, respectively extending from the forward and rearward faces thereof. The construction and operation of the system 110 is substantially similar to that described in connection with the assembly 10. Those skilled in the art will appreciate though, that the slotted connection provided for each individual panel 114 (using screws 152 and covers 188 in each instance) permits the skirt and the respective skirt-defining panels to shift vertically as needed to accommodate ground movements; moreover, the upper cover member 126, being free of interconnection to the building 12**, freely shifts with the skirt-defining panels in the manner described above.

Figure 9:
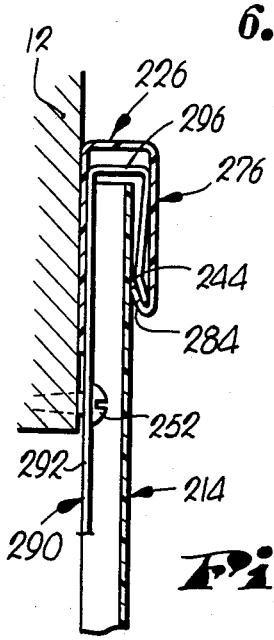
FIG. 9 is a vertical section view taken along line 9—9 of FIG. 8 which illustrates further details of this embodiment of the invention.
Figure 8:
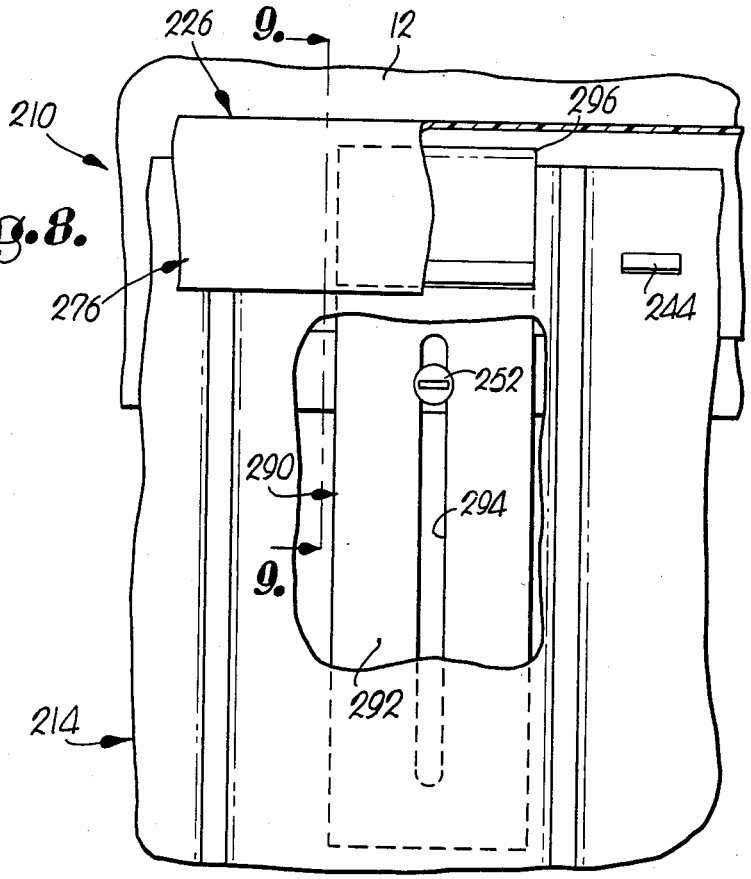
FIG. 8 is a fragmentary front view with parts broken away for clarity illustrating another embodiment of the invention.

Turning now to FIGS. 8 and 9, another embodiment of the invention is depicted. In this embodiment a skirting assembly 210 is illustrated which is made up of a plurality of interconnected, identical skirt-defining panels 214 having upper tabs 244 and lower tabs (not shown). For purposes of the embodiment depicted in FIGS. 8–9, any suitable interconnection structure between the adjacent vertical edges of respective panels 214 would be appropriate; in the depicted embodiment, interfitting flange structures essentially similar to those described in conjunction with the assembly 10 are employed to connect the panels 214 in an endwise fashion. In any event, the assembly 210 makes use of a plurality of hanger clips 290 for purposes of securing the skirt to the building 12. Each clip includes an elongated upright slotted portion 292 having a slot 294 therein, and an upper portion 296 of inverted, generally U-shaped configuration. A screw 252 extends through the slot 294 and passes into building 12 (see FIG. 9), in order to couple the clip 290 to the building while permitting vertical shifting thereof along the length of the slot 294. The upper end 296 of the clip 290 is configured to pass over the upper margin of the adjacent panel, with the forward leg of the portion 296 extending downwardly along the outer face of the panel.

In order to cover the exposed portions of the clips 290, and to provide the desirable covering function, the upper cover 226 is employed. This cover again is made up of a plurality of endwise positioned channel members 276 of inverted, generally U-shaped configuration. The forward leg of each section 276 has a return flange 284 which is engageable with corresponding panel tab(s) 244 so that the upper cover shifts upwardly with the associated skirt-defining panels. As seen in FIG. 9, the cover extends over and matingly engages the portions 296 of the clips 290, particularly at the region of the flanges 284; moreover, cover 226 is free of connection to the building 12. A lower cover (not shown) is also provided which is essentially identical with cover 25 described above.

The clips 290 can be installed at various locations along the length of building 12, there being no need to precisely position the clips at the joinder of panels 214. Generally speaking, each panel 214 is provided with an associated clip 290. It will also be readily apparent that during ground-induced shifting of the skirt-defining panels 214, the clips 290 likewise vertically shift with the panels and with the cover means 226. In this fashion, the desirable free up and down shifting of the skirt assembly 210, and the cover means 226, is achieved.

We claim:

1. A skirting assembly for closing the space beneath an elevated building and comprising:

a plurality of upright panels disposed in a generally end-to-end relationship;

means for interconnecting said panels to present a substantially continuous closing skirt having an elongated upper margin and a pair of opposed faces;

connector means for securing said skirt beneath said building, and for permitting up and down reciprocal travel of the skirt, including structure for fixed securement to said building and means operably coupled with said structure for engaging said skirt in a manner to permit said travel thereof, at least certain of said panels having an elongated, upright slot therein, said connector means comprising screw means extending through respective slots for fixed securement to said building; and cover means for covering said upper margin and including an elongated channel member of inverted, generally U-shaped configuration having depending legs, said channel member being positioned over a portion of said upper margin with said legs respectively disposed proximal to one of the opposed faces of said skirt, said channel member being free of fixed securement to said building for up and down movement of the channel member with said movement of said skirt.

2. The skirting assembly of claim 1, said interconnecting means comprising mating interlock flanges on adjacent upright edges of said panels.

3. The skirting assembly of claim 1, including respective, elongated, upright cover means in covering disposition to said slots.

4. The skirting assembly of claim 1, including means for connecting said channel member to said skirt.

5. The skirting assembly of claim 4, said means for connecting said channel member to said skirt comprising an outwardly extending locking tab on said skirt, and a cooperating interlocking return flange portion on said channel member.

6. The skirting assembly of claim 1, including a lowermost, ground-engaging cover operably engaging said skirt and covering the lower marginal edge thereof.

7. A skirting assembly for closing the space beneath an elevated building and comprising:

a plurality of upright panels disposed in a generally end-to-end relationship;

means for interconnecting said panels to present a substantially continuous closing skirt having an elongated upper margin and a pair of opposed faces;

connector means for securing said skirt beneath said building, and for permitting up and down reciprocal travel of the skirt, including structure for fixed securement to said building and means operably coupled with said structure for engaging said skirt in a manner to permit said travel thereof said connector means comprising a clip member including an elongated, upright slotted portion and an upper portion of inverted generally U-shaped configuration, and screw means passing through said slot for fixed securement to said building, said upper portion being configured to pass over said upper margin and be housed within said channel member and locked thereto, with said slotted portion positioned behind said skirt; and cover means for covering said upper margin and including an elongated channel member of inverted, generally U-shaped configuration having depending legs, said channel member being positioned over a portion of said upper margin with said legs respectively disposed proximal to one of the opposed faces of said skirt, said channel member being free of fixed securement to said building for up and down movement of the channel member with said movement of said skirt.

* * * * *